United States Patent [19]

Hosaka et al.

[11] Patent Number: 4,857,960

[45] Date of Patent: Aug. 15, 1989

[54] CONTROL DEVICE FOR IMAGE PROCESSING OR FORMING APPARATUS

[75] Inventors: Masao Hosaka, Sagamihara; Kazutoshi Shimada, Kawasaki; Hisashi Sakamaki, Yokohama, all of Japan

[73] Assignee: Canon Kabushiki Kaisha, Tokyo, Japan

[21] Appl. No.: 894,106

[22] Filed: Aug. 7, 1986

[30] Foreign Application Priority Data

Aug. 9, 1985 [JP] Japan ..... 60-174311
Aug. 30, 1985 [JP] Japan ..... 60-191730

[51] Int. Cl.[4] ..... G03G 15/00; G03G 21/00
[52] U.S. Cl. ..... 355/208; 355/525
[58] Field of Search ..... 355/14 R, 14 C, 14 CU

[56] References Cited

U.S. PATENT DOCUMENTS 4,144,550 3/1979 Donohue et al. ..... 355/14 C X
4,202,622 5/1980 Kawatsura et al. ..... 355/14 C
4,222,105 9/1980 Shimizu et al. ..... 355/14 C X
4,306,803 12/1981 Donohue et al. ..... 355/14 C
4,375,917 3/1983 Hiraike et al. ..... 355/14 C X
4,420,247 12/1983 Suzuki et al. ..... 355/14 C

FOREIGN PATENT DOCUMENTS 0105667 4/1984 European Pat. Off. .
3049339 9/1981 Fed. Rep. of Germany .
3422351 12/1984 Fed. Rep. of Germany .

*Primary Examiner*—Fred L. Braun
*Attorney, Agent, or Firm*—Fitzpatrick, Cella, Harper & Scinto

[57] ABSTRACT

A control device for controlling plural analog devices in an image processing apparatus. The control device has a first controller for controlling the function sequence of analog devices, an analog-to-digital converter for obtaining digitals signals from the plural analog devices, and a second controller for controlling the analog devices to effect image processing by executing particular commands specified by the first controller, in response to the digital signals from the analog-to-digital converter.

21 Claims, 13 Drawing Sheets

CONTROL DEVICE FOR IMAGE PROCESSING OR FORMING APPARATUS

BACKGROUND OF THE INVENTION

1. Field of the Invention

The present invention relates to a control device for an image processing apparatus or an image forming apparatus.

2. Related Background Art

Recent progress in electronics is particularly marked in the fields of office automation, factory automation, laboratory automation, etc., and such progress can be attributed to a skilful combination of electronics and mechanisms. Naturally it is basically supported by the amalgamation of ever-progressing semiconductor integration and computer technology, since inexpensive mass production has to rely on the use of system large-scale integrated circuits. However, there is still much to be improved in the mechanisms, particularly in the interface portion between analog-functioning components and digital control electronics. In the current state of technology, most digital control electronics only perform simple on-off control for analog components. For this reason such analog components still have complex control systems of their own, and the potential of the digital control electronics is not fully exploited in such interface systems. Consequently there still exists an unnecessary cost associated with such interface systems, which has to be borne by the users.

Presently such digital control electronics are mostly microcomputers or microcontrollers which are one-chip microcomputers incorporating memories and I/O ports. For controlling such analog components, there is already known a one-chip microcomputer incorporating an A/D converter on the same chip. Also there is announced a controller incorporating a counter/timer, an A/D controller, and an interface for PWM output/-display devices such as an LCD interface driver in addition to a CPU and a memory. However these conventional devices are simple large-scale integrated circuits in which already known components are combined, and are unable to eliminate the above-mentioned drawbacks particularly present in the interface portion between analog-functioning components and digital control electronics, as many analog components will contain their own control units therein due to the requirement for proper processing speed and the complexity inherent in their control. Consequently, equipment involving analog components is associated with a higher cost.

Particularly, equipment employing a large number of analog components, such as a copying machine, has inevitably suffered from an elevated manufacturing cost.

SUMMARY OF THE INVENTION

An object of the present invention is to provide an improvement in the control device for an image processing apparatus or an image forming apparatus.

Another object of the present invention is to eliminate the aforementioned drawbacks in the prior technology.

Still another object of the present invention is to provide a control device for an image processing apparatus or an image forming apparatus, capable of controlling plural analog-functioning devices with a control device.

Still another object of the present invention is to minimize the loss in the interface portion between analog-functioning components and digital control electronics.

Still another object of the present invention is to provide a control device achieving advanced unification and amalgamation of the analog-functioning components and the digital control electronics.

Still another object of the present invention is to provide a control device for an image processing apparatus or an image forming apparatus, capable of achieving reasonable and flexible digital control over a maximum range of the apparatus, through centralizing control and control information and unifying the control process, thereby permitting simplification each component.

Still another object of the present invention is to control, in an image processing apparatus or an image forming apparatus such as a copying machine, plural analog quantities by means of a control means.

According to the present invention, these objects are attained by providing a control device for use in an image copying apparatus. An analog variable of one or more analog function elements (e.g., a lamp, a heater, etc.) is detected and a resulting analog signal is converted to a digital signal. The analog function element(s) are under control of a control means operating according to a stored image processing control program. A pulse-width modulated signal is generated and output for each analog function element, based on the analog signal therefrom. The A/D conversion device, memory, control means, generating means and input and output ports are provided on one chip to form a one-chip controller.

The foregoing and still other objects of the present invention will become fully apparent from the following description.

DETAILED DESCRIPTION OF THE PREFERRED EMBODIMENT

Now the present invention will be clarified in greater detail by detailed description of an embodiment thereof, shown in the attached drawings.

Figure 1:
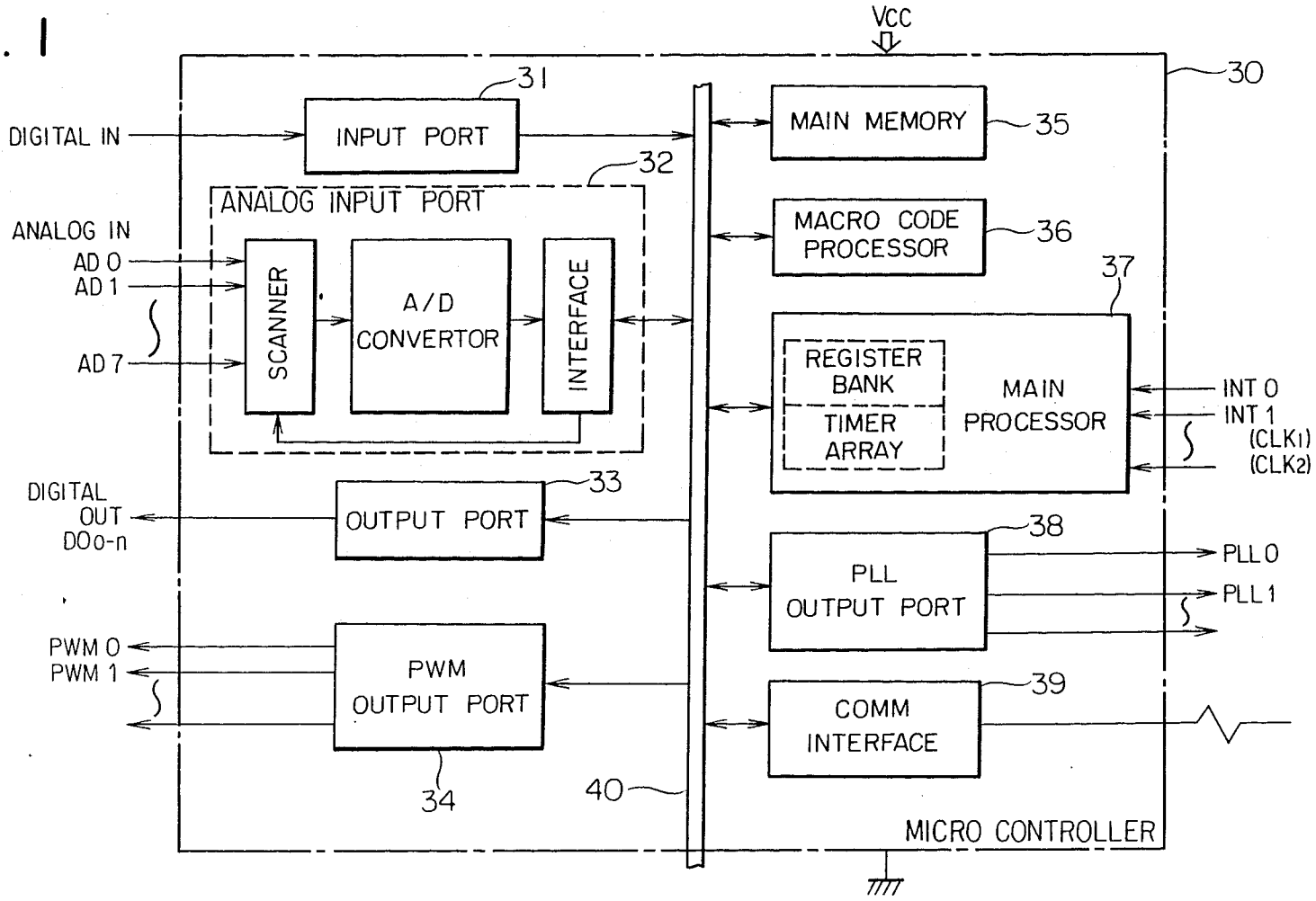
FIG. 1 is a block diagram of a control device embodying the present invention.

FIG. 1 is a block diagram of a control device for an image processing or forming apparatus embodying the present invention.

Figure 2:
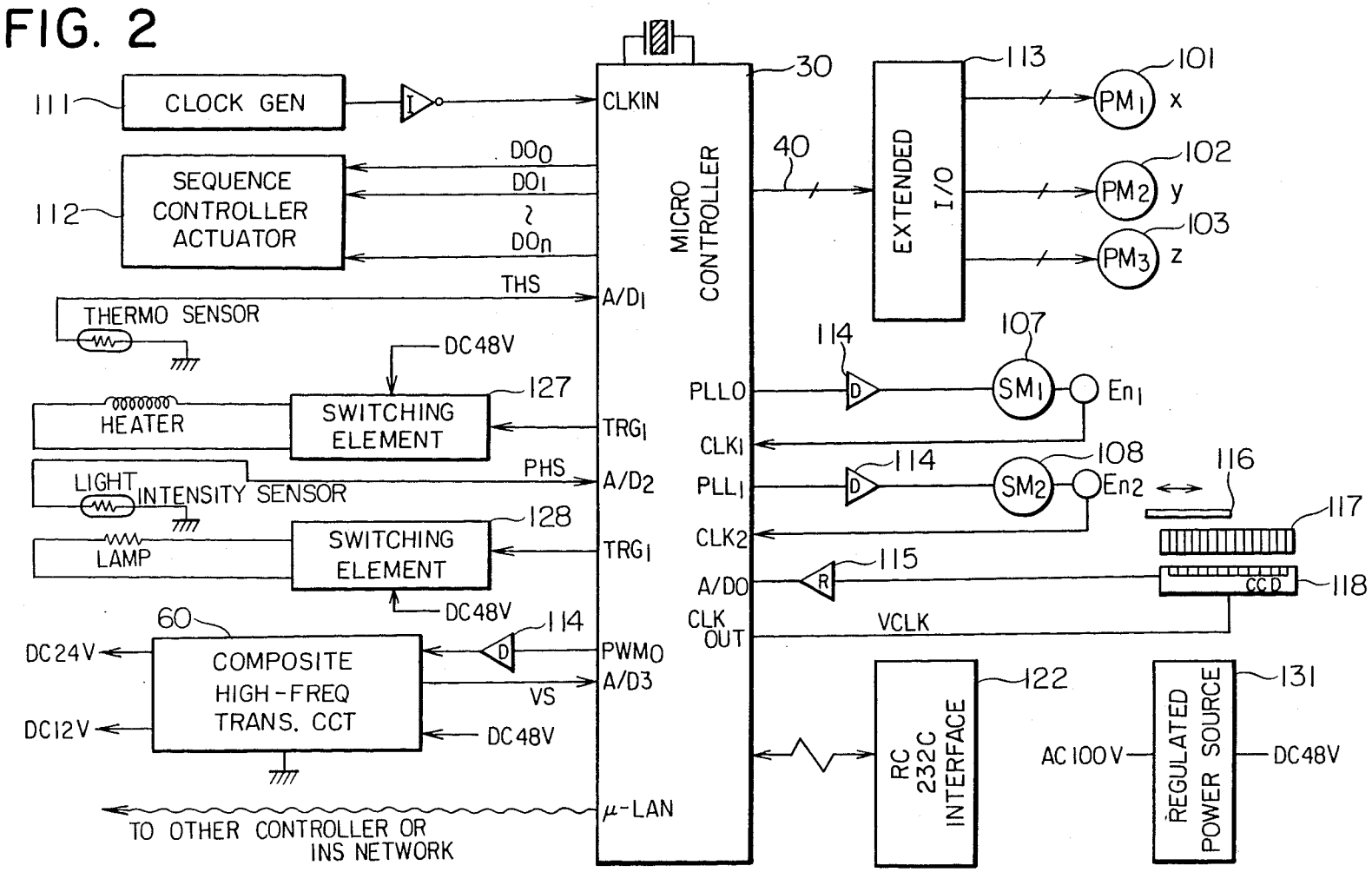
FIG. 2 is a block diagram of an example of control by a control device 30.

In FIG. 1 there are provided an input port 31 for digital signals; an input port 32 for analog signals, incorporating a scanner for achieving high-speed scanning of eight analog input channels AD0–AD7, an A/D converter and an interface; an output port 33 for digital signals, having channels DO0–DOn; an output port 34 for pulse-width modulated signals PWM0, PWM1, . . . ; a main memory 35 including a ROM for storing a control program and a RAM for storing information necessary for the control; a macrocode processor 36 capable of executing a macroinstruction, corresponding to several hundred bytes, in 1 to 2 microseconds; a main processor 37 of a processing speed several times higher than that of ordinary general-purpose microprocessors; a PLL output port 38 for releasing phase-locked loop signals PLL0, PLL1, . . . as control signals for example for servo motors 107, 108 shown in FIG. 2; and a communication interface 39 for effecting data communication with an external device.

The main processor 37 is provided with external interruption channels INT0, INT1, . . . , and is capable of functioning with a speed of several hundred nanoseconds per instruction. It is further provided with a registor bank composed of plural registers, and is capable of making access in bit units to the input/output ports. Furthermore, the main processor 37 is provided with 16 channels of 16 bit timer/counters, and is capable of effective timer process by zero-cross point detection through this timer array. The main processor 37 has two major functions, i.e., to judge control procedure as a sequencer of the apparatus, and to suitably control the macrocode processor 36 for the purpose of analog control.

The analog input port 32 has eight analog input channels. Data scanned according to the interface are converted into digital data in the A/D converter and are stored in succession in the RAM of the interface. The priority of scanning can be varied by scanner control data supplied from the main processor 37. For example, the scanning can be conducted in succession in the analog input channels from 0 to 7, or from 0 to 4 only, or from 4 to 7 only. The interface of the analog input port 32 is provided with data storage RAM's respectively corresponding to analog input channels, whereby the comparison of magnitude with preset reference values can be achieved without the assistance of the processors 36, 37. For example it is possible to identify whether a variable remains in a range defined by an upper limit and a lower limit, and an internal interruption procedure is started in the main processor 37 in case the variable exceeds said range. Thus in the detection of an external analog variable by sampling, the internal interruption procedure is triggered in the processor 37 only in case said variable shows a change tresspassing a threshold value. In response the processor 37 inspects the input data at the start of interruption and the channel of interruption, and provides the macrocode processor 36 with a particular macroinstruction according to the result of said inspection. In response the macrocode processor 36 effects a high-speed processing of said input data to obtain a control amount for maintaining the controlled variable at a target value, and supplies the result of processing for example to the PWM output port 34. The above-explained feedback control, consisting of the steps of A/D conversion of the controlled variabale, input to the interruption port, inspection of the interruption procedure by the main processor 37, processing by the macrocode processor 36, and output of the control amount by the PWM output port 34, can be completed in about 2 microseconds. Thus, in the case of controlling the intensity of a lamp, temperature of a heater, speed of servo motors 107, 108, and output of a DC power source (comples high-frequency transformer circuit 60), as shown in FIG. 2, as analog variables, a corresponding macroinstruction is defined for each analog component and is set in the macrocode processor 36. In this manner the main processor 37 can obtain control information (PWM, PLL) of each analog component from the macrocode processor 36 by the execution of a macrocode instruction, and can therefore perform control service to all the components within several tens of microseconds. This is a sufficiently long response time for each component mentioned above.

The main function of the macrocode processor 36 is to replace so-called PWM feedback control or PLL feedback control, which has been achieved by an operational amplifier and an associated circuit, with a software control achieved by the execution of a set of microinstructions. For example, a conventional amplified output dA of a difference d detected in the operational amplifier can be replaced by the execution of a microinstruction set for multiplying a constant A with a threshold value d which has triggered the interruption procedure. Also, in a complex functional calculation, the input data are used as an address input variable x, and a result y prepared in advance is read from a high-speed ROM. In this manner certain conventional controls such as PWM or PLL can be represented by a microinstruction set or a macrocode of a unified control theory. For example, in a case where the analog component is a stabilized DC power source, plural power sources can be controlled in a unified manner by a microinstruction set through the selection of suitable parameters.

In this manner the control of plural analog components can be centralized. The present embodiment has an effect of replacing the control circuits in various analog components with a single hardware device composed of the macrocode processor 36, but its significance exceeds even that advance. In the first place, it means that the controlled variables of important plural analog components are centralized in the processors 36, 37. Consequently, the main processor 37 can correlate the functions of plural analog components, and this fact is particularly useful for example in the control of a copying machine. For example the main processor 37 can identify that a high-voltage generating device alone is not properly controlled while all other analog components are properly controlled. Consequently the main processor 37 can accurately identify the cause of deterioration of image quality in an early stage before a fatal trouble occurs, and can therefore issue an alarm to the operator if necessary. Secondly the controlled variables of important plural analog components are not only collected at the processors 36, 37 but also corresponding control values can be actively varied. This fact is also extremely useful in a copying machine. For example, in case the cause of deterioration of image quality is well identified as explained before, the main processor 37 can correct such deterioration by varying the control values of other analog components. Such control can be achieved by a suitable offset in A/D converted output data before it is given by the main processor 37 to the macrocode processor 36.

The communication interface 39 has a standardized communication protocol, called μ-LAN, for communication of 64 KBPS, and allows the use of the present control device as a terminal of a digital communication network.

FIG. 2 is a block diagram illustrating a case in which the control device 30 of the present embodiment is employed for controlling analog components.

One of the functions of the control device 30 is to control the 3-axis position (X, Y, Z) of a movable member 116 and the running thereof through three 5-phase stepping motors 101–103, by detecting precise X-Y position of the movable member 116 in response to the output of a CCD 118.

The position of the movable member 116 is determined by the CCD sensor 118 which detects the shadow of said movable member 116, in the movement thereof, through a short-focus lens array 117. The output of the CCD sensor 118 is supplied through a receiver 115 to a port A/D0 whereby the main processor 37 is activated in response to a density change in the video signal. Video clock signals VCLK for driving the CCD are supplied by the microcontroller 30. Each of the 5-phase stepping motors 101–103 for moving the movable member 116 requires 10 wirings and 10 phase pulses. Consequently, 30 lines are required for 3-axis control, and an extension I/O 113 is provided for controlling the stepping motors 101–103. The I/O chip 113 is provided with a RAM for storing pulse patterns supplied in advance from the microcontroller 30, and control pulses for the stepping motors 101–103 are supplied from RAM in response to a start signal from the microcontroller 30.

The microcontroller 30 also executes PLL control of the servo motors 107, 108. Said motors generate encoder pulses which are respectively supplied to ports CLK1, CLK2 of the microcontroller 30 and are counted by an interruption procedure in the main processor 37.

Also, the microcontroller 30 effects on-off control of a sequence controller actuator 112, which receives on/-off signals for solenoids, clutches, valves, etc., from the microcontroller 30 according to the proceeding of sequence and controls the corresponding components. Said control includes not only simple on/off control but also certain time-controlled on/off control, which is achieved by full exploitation of 16-channel timer/counters in the main processor 37 of the microcontroller 30.

The microcontroller 30 also controls the temperature of a heater and the intensity of a lamp. Such temperature and intensity control are externally achieved by switching elements 127, 128 and sensors only, and the processing of detection signals from the sensor and the control of said switching elements 127, 128 according to the result of processing are all executed by the microcontroller 30. As an example, a phase control of electric power of AC 100V supplied to a halogen lamp will be explained later.

Furthermore, the microcontroller 30 controls DC voltages through a complex high-frequency transformer circuit 60. More specifically, it controls, through PWM0 outputs, a switching regulator composed of a driver 114 and a complex high-frequency transformer circuit 60 to generate DC voltages of 24V and 12V. The microcontroller 30 inspects a smoothed secondary voltage VS received through a port A/D3, and regulates the duty ratio of the PWM output signal in the case that a change in the load is acticipated or if detected voltage VS exceeds a predetermined range, thereby responding to the fluctuation in the loads.

Figure 3:
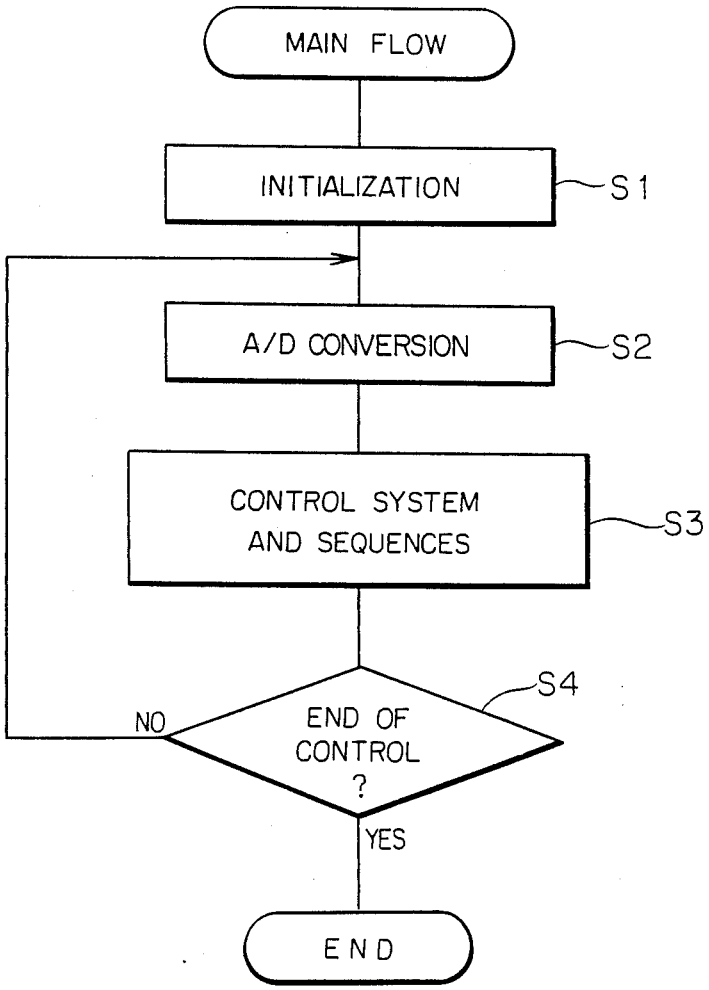
FIG. 3 is a main flow chart of a main processor 37.

FIG. 3 is a main flow chart showing the control procedure of the main processor 37 shown in FIG. 2. A corresponding program is stored in the main memory 35.

After the start of power supply, the main processor 37 initializes input/output ports in a step S1, and sets scan control data for analog input signals in the interface of the analog input port 32 in a step S2, whereby the analog input port 32 converts the input analog data into digital data according to the thus set scan data and stores said digital data in the RAM of the interface.

A succeeding step S3 performs system control and sequence control of the components shown in FIG. 2. The steps S2 and S3 are repeated until the completion of control is identified in a step S4.

Figure 4:
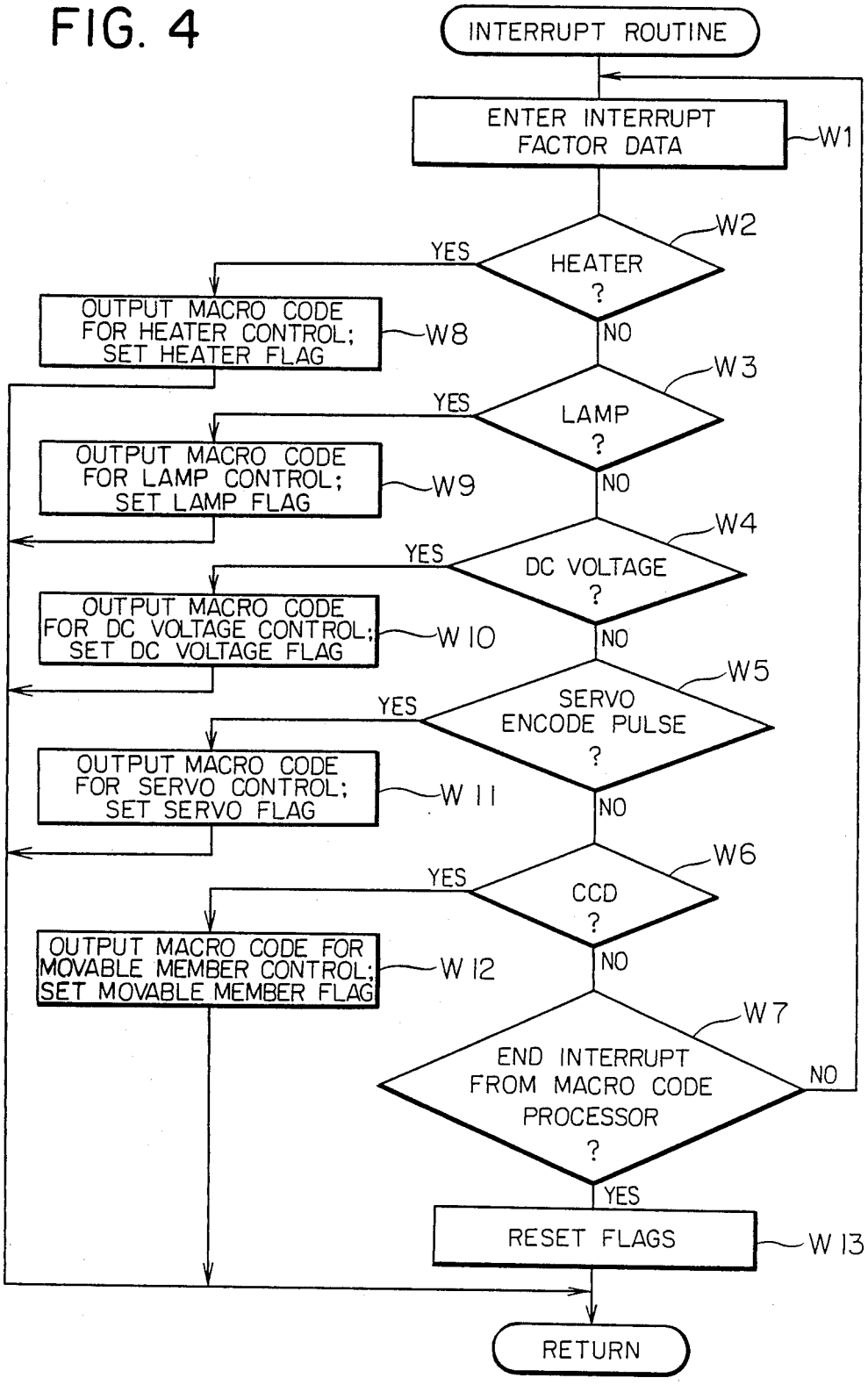
FIG. 4 is a flow chart showing an interruption routine.

FIG. 4 shows an interruption routine to be executed by the main processor 37 in response to an internal demand for interruption from the analog input port 32, macrocode processor 36, etc.

In response to such demand, the main processor 37 executes said interruption routine, interrupting a control procedure currently executed, and returns to said control procedure after said interruption routine is completed.

In FIG. 4, a step W1 enters interruption factor data for discriminating the source of demand for interruption, then steps W2–W7 discriminate said source (heater, lamp, DC voltage, encoder pulse of the servo motors, CCD 18 or macroprocessor 36 in the case of FIG. 2), and, upon said discrimination, steps W8–W12 supply the macrocode processor 36 with a macrocode corresponding to thus discriminated source (a heater control macrocode, a lamp control macrocode, a DC voltage control macrocode, a servo motor control macrocode or a movable member control macrocode) and set a flag corresponding to said macrocode. Said flag allows identification of the species of control executed by the macrocode processor 36. Upon completion of a control procedure corresponding to said macrocode, the macrocode processor 36 requests an end interruption procedure to the main processor 37, which confirms said request in the step W7 and resets the flag, in a step W13, for the completed macrocode process.

The interface of the analog input port discriminates whether each analog input is within a predetermined range as explained before, and requests an interruption procedure to the main processor 37 in case said range is exceeded.

Figure 5:
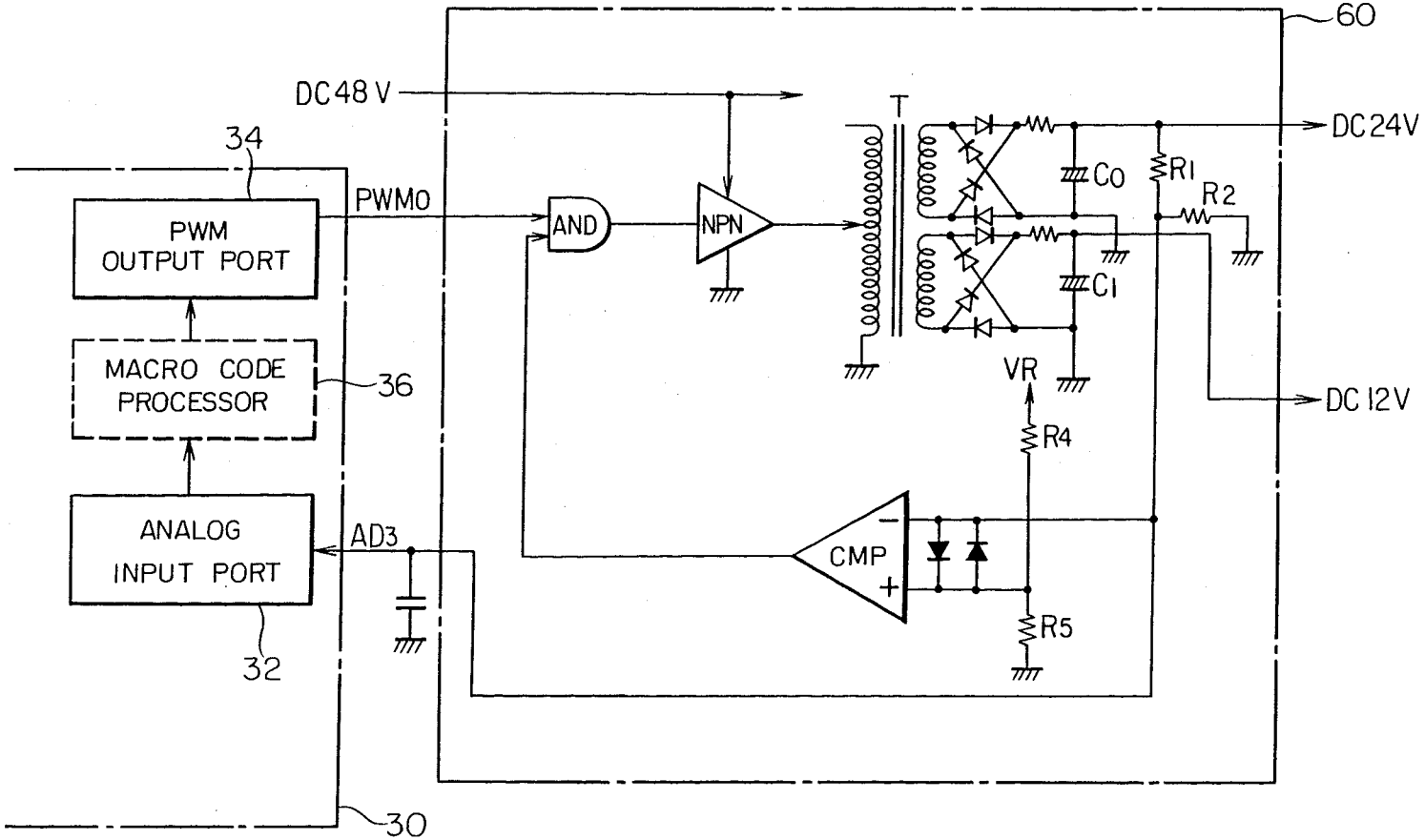
FIG. 5 is a block diagram of a DC voltage control circuit.

FIG. 5 is a circuit diagram of the complex high-frequency transformer circuit 60, constituting a chopper-type low-voltage power supply, switching an input power of DC 48V with a driver NPN in response to the PWM0 signal to obtain DC 24V and DC 12V. The switching control is conducted through the channel 0 of the PWM output port, with a frequency of 30 to 50 KHz. A monitor output voltage, obtained by dividing the DC 24V with resistors R1, R2, is supplied to a comparator CMP constituting a protective circuit for an excessive voltage. In case of such excessive voltage the comparator CMP releases a zero signal to close an AND gate. Said monitor output voltage is also supplied to a port AD3 of the analog input port 32 in the controller 30. The macrocode processor 36 calculates the difference between the input data and a predetermined reference value and determines the value of PWM signal so as to obtain a constant output of DC 24V. The result of said calculation is set in a corresponding register in the PWM output port 34. In case of a sequence control conducted with predetermined timing, such as in a copying machine, the controller 30 can predict the variation in the loads and can therefore regulate the PWM signal in advance, if desired. In the present embodiment, the output of DE 12V is maintained at a fixed relation to the output of DC 24V. In the circuit shown in FIG. 5, an abnormality in the output voltage is inspected in digital manner through the analog input port 32, and the protecting comparator CMP provides an additional safety in case of eventual failure of the controller 30.

Figure 6:
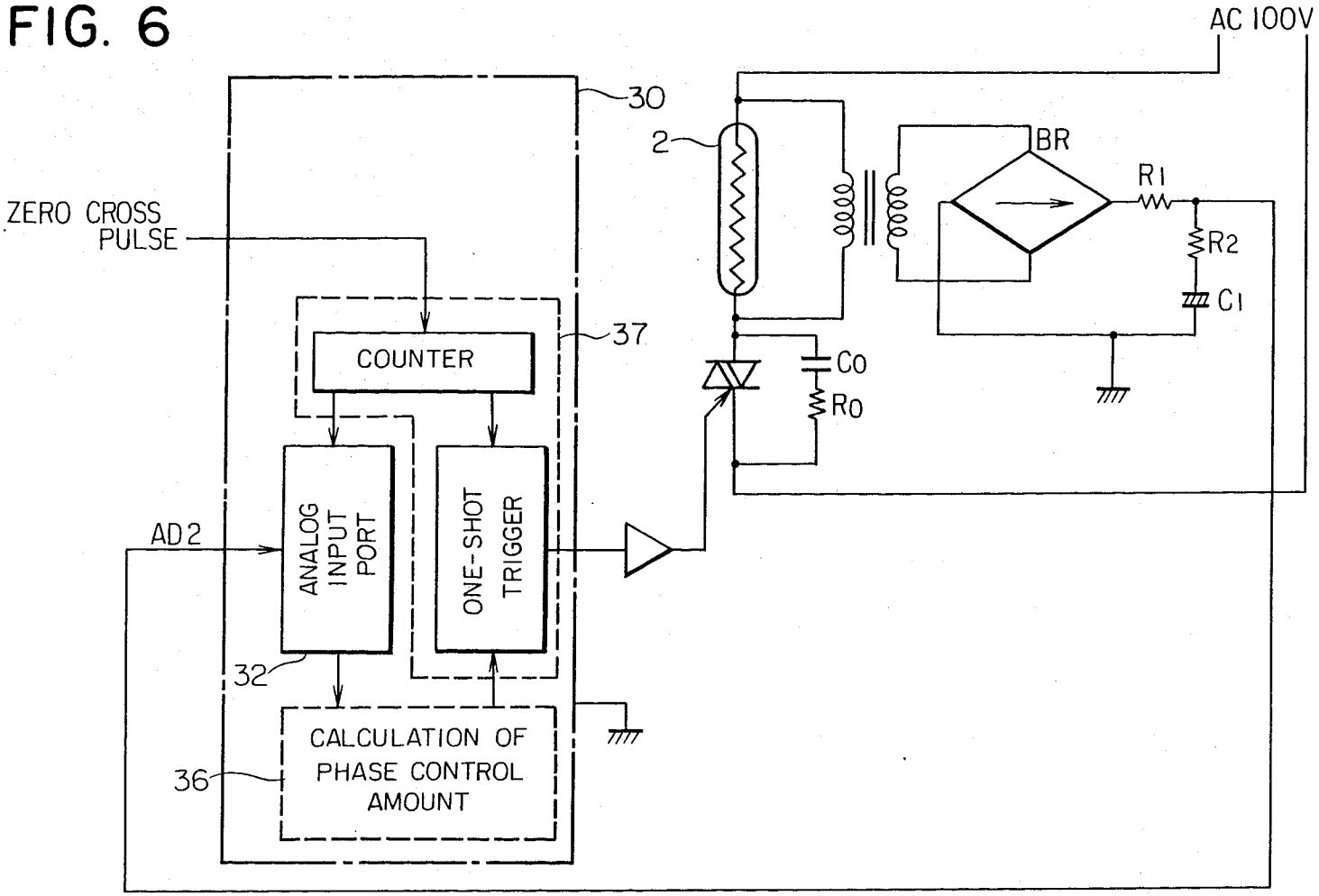
FIG. 6 is a block diagram of a circuit for controlling a halogen lamp 2.

FIG. 6 is a block diagram showing the details of a halogen lamp control. In this control the control device 30 utilizes functions of zero-cross detection for external AC input signal, analog input port 32, a counter and a one-shot trigger. For zero-cross detection, for detecting the crossing points of an AC input signal with zero volt level, there is required a compensating circuit since the control device 30 has only one power source. The compensating circuit is already well known and is therefore omitted. Upon detection of a zero-cross pulse, a counter is activated in the main processor 37, and, when a predetermined count is reached (for a cycle of 10 ms or a half-cycle of 5 ms for an AC input of 50 Hz), an internal interruption procedure is initiated to activate the A/D converter in the analog input port 32. Also the phase control amount for a halogen lamp 2 is calculated from the data previously converted by the A/D conver, and the one-shot trigger is activated according to the result of said calculation to bias a triac. In this manner the control device 30 performs a function of zero-cross pulse detection, counting operation by the counter and start of A/D conversion, and another function of one-shot trigger, in parallel manner. For calculating a pseudo-effective value, a wave form detected across the halogen lamp is rectified by a diode bridge BR as shown in FIG. 6, and an analog average voltage obtained from a voltage divider composed of the resistors R1, R2 is supplied to the port A/D.

Figure 7:
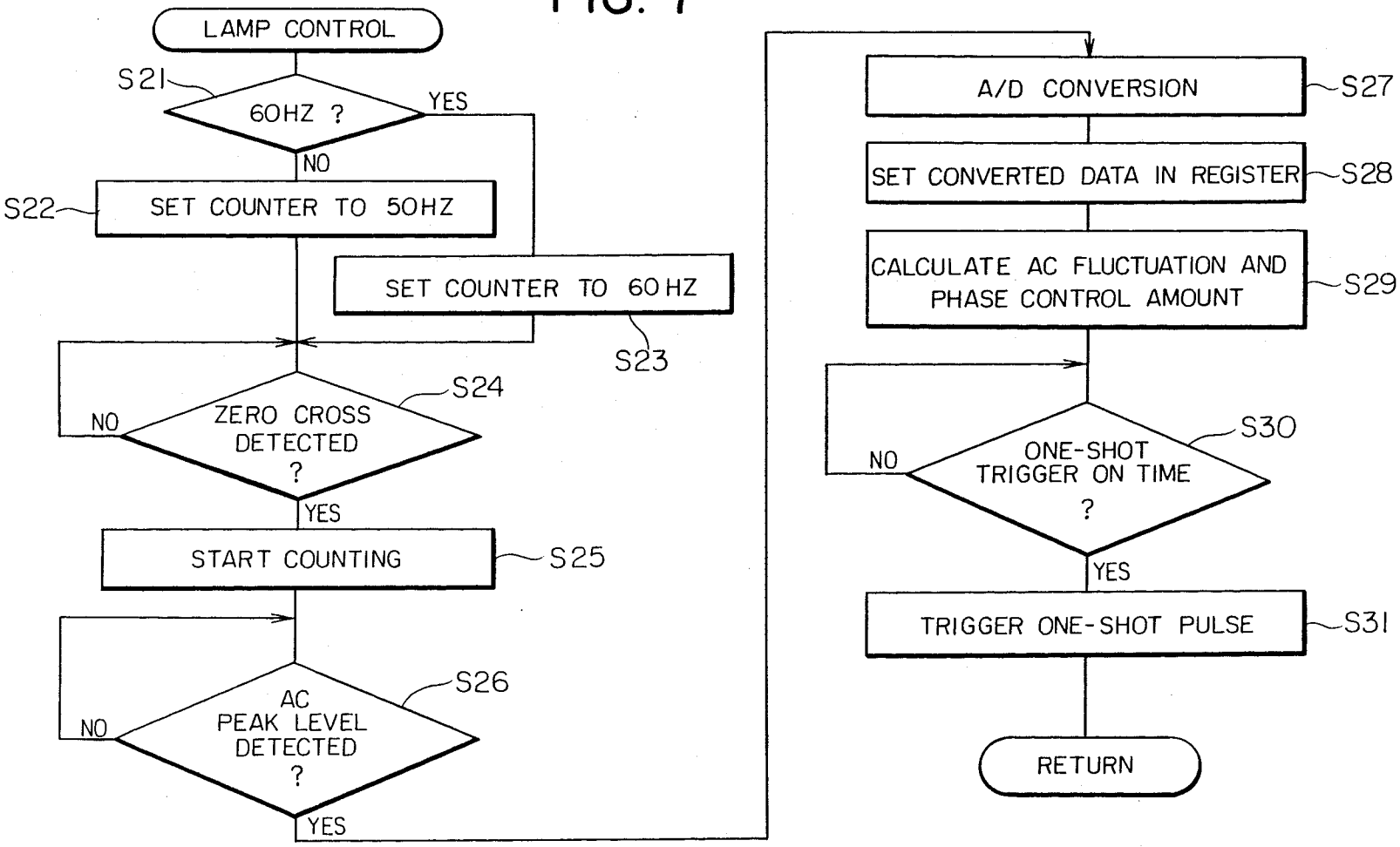
FIG. 7 is a flow chart of a macrocode processor in case of lamp control.

FIG. 7 shows a flow chart for lamp control, to be executed by the macrocode processor 36 when it is activated by the main processor 37. Said lamp control flow chart is executed by the lamp control macrocode shown in FIG. 4. In the flow chart shown in FIG. 7, a step S21 discriminates whether the input frequency is 60 Hz, and steps S22, S23 set the counter to 50 Hz or 60 Hz according to the result of said discrimination. A step S24 executes a zero-cross detection, and a step S25 starts a counting operation of the counter. A step S26 detects a predetermined value (peak value of the AC input voltage; 5 msec in case of 50 Hz), and a step S27 initiates the A/D conversion. Then a step S28 sets the A/D converted data in a register, while a step S29 calculates the amount of phase control from the variation in the AC input voltage, and a step S30 tests the trigger timing of the one-shot trigger for triggering the triac. This control is conducted parallel to the start of the A/D converter responding to the counting operation initiated in the step S26. However the initial one-shot trigger is delayed by one cycle from the A/D converter, since the timing of the one-shot trigger is determined from the result of preceding A/D conversion. A step S30 releases a one-shot trigger signal. The above-explained procedure is continued in this manner.

Figure 8:
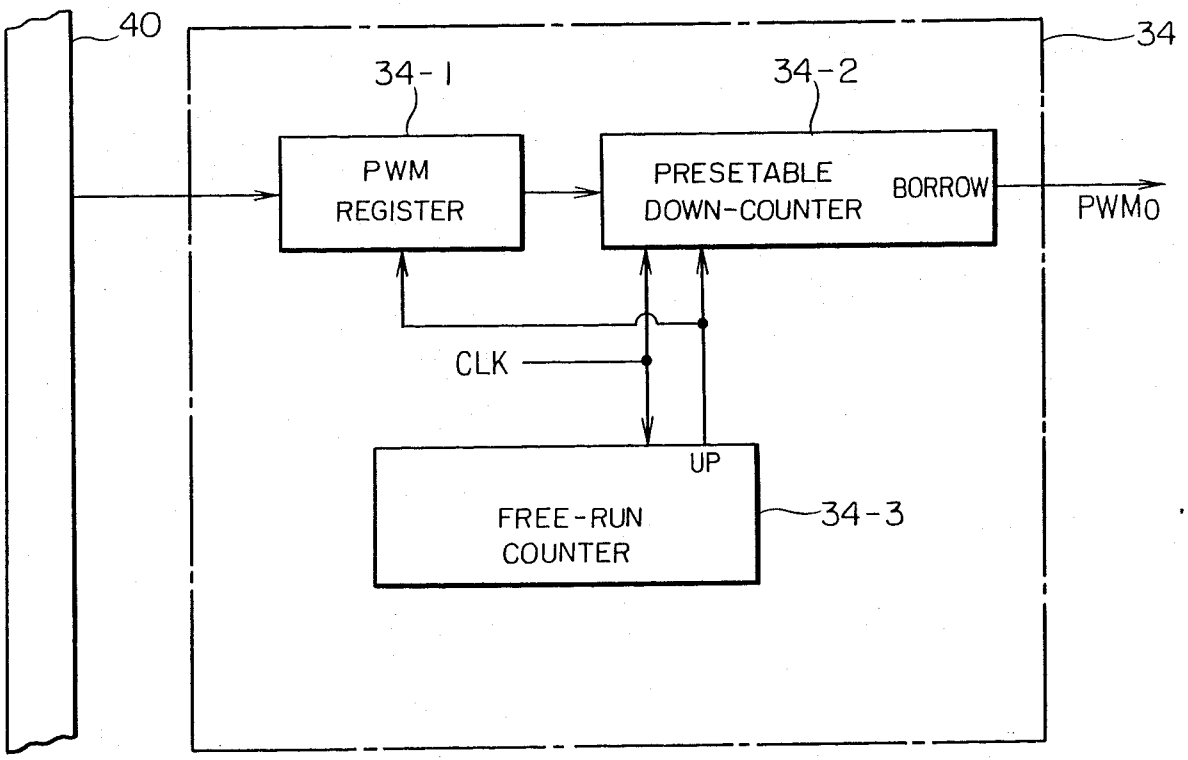
FIG. 8 is a block diagram of a PWM output port 34.
Figure 9:
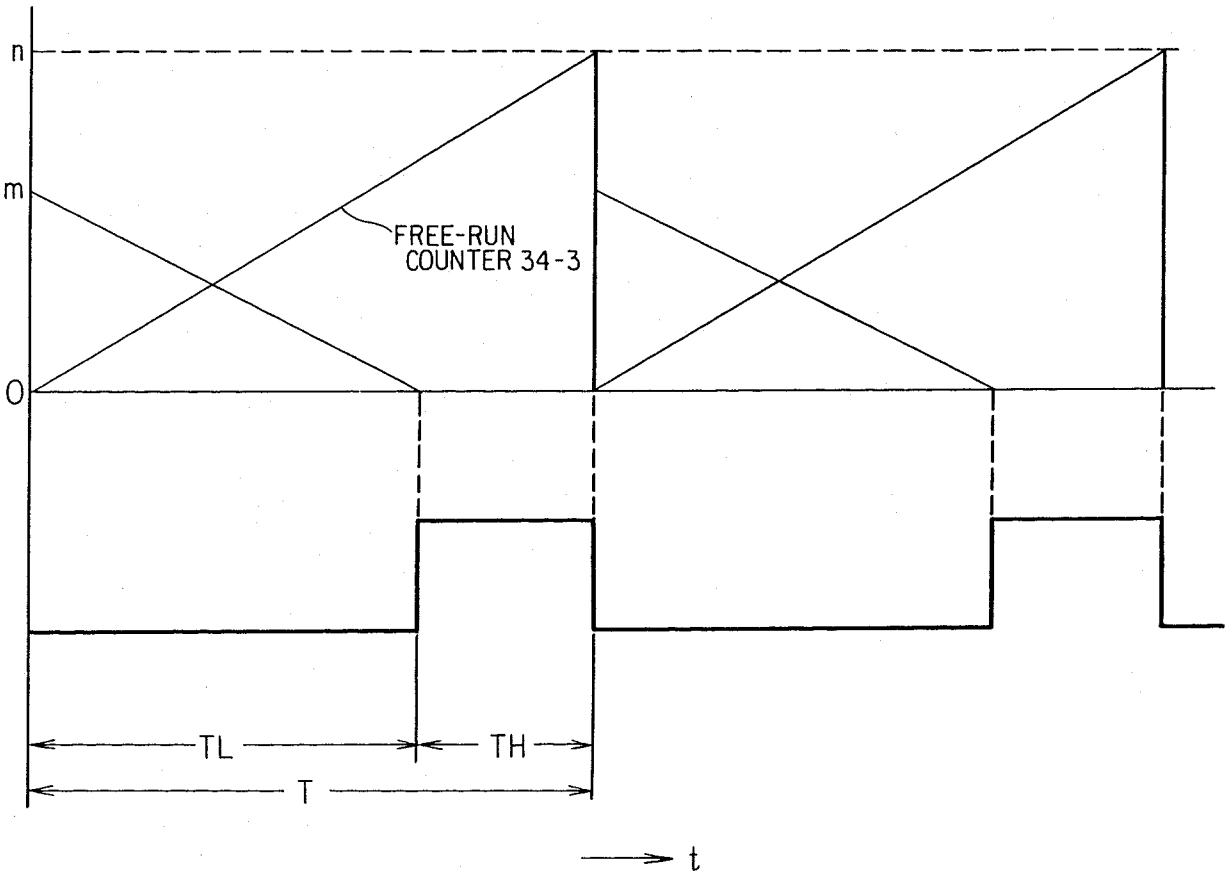
FIG. 9 is a wave form chart of PWM output.

FIG. 8 is a block diagram showing one channel of the PWM output port 34 of the present embodiment, and FIG. 9 is a wave form chart showing the PWM output signal released from the PWM output port showing FIG. 8.

The resolving power of the PWM output port 34 is determined by the decrement cycle T of a free-run counter 34-3, while the low-level pulse width TL is determined by a presettable down-counter 34-2, of which count value is determined by a PWM register 34-1, by a count-up signal UP indicating the completion of an up-count of the free-run counter 34-3. Said presettable down-counter 34-2 releases a high-level signal in response to a borrow signal, and a low-level signal in response to the count-up signal from the free-run counter 34-3.

As explained in the foregoing, the present embodiment performs centralized control of plural analog components, thereby enabling one to replace the control circuits in such analog components with a single hardware unit which is the macrocode processor 36 and to achieve centralized administration of the control information and unified control scheme. Consequently apparatus realized with the present embodiment can achieve a reduction in the number of modules, compactization and multiple functions in comparison with the conventional technology.

In the following there will be explained an embodiment in which the control device of the foregoing embodiment is applied in a copying machine.

Figure 10:
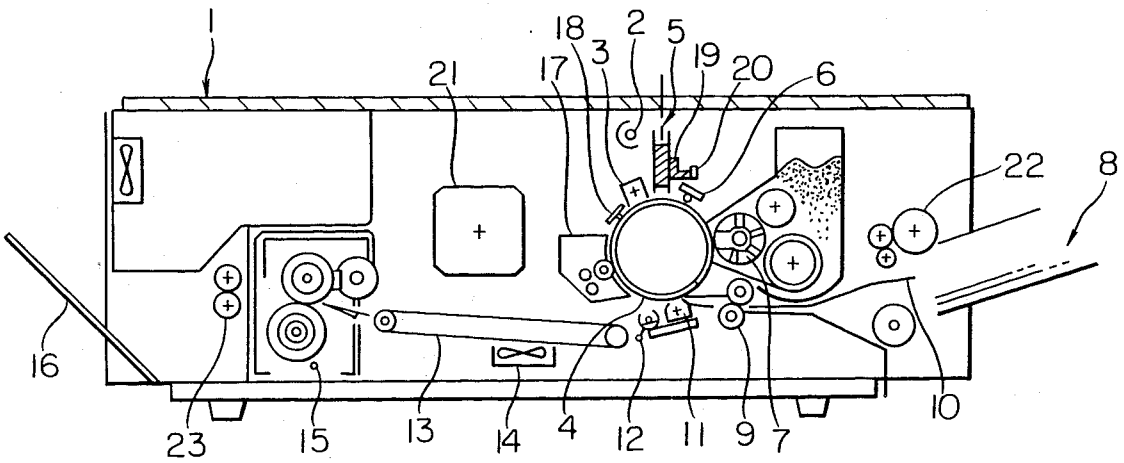
FIG. 10 is a cross-sectional view of a copying machine.

At first there will be given an explanation on the copying machine to be controlled by the control device 30, of which a cross-sectional view is shown in FIG. 10.

Referring to FIG. 10, the user at first sets an original document to be copied on an orignal support table 1, then sets the number of copies and the copy density. In this setting, an automatic density control or a manual density control is selected by a key switch. If the machine is ready for copying operation (i.e. a fixing heater is at a predetermined temperature, various mechanisms are at predetermined home positions and necessary supply materials such as toner and paper are prepared), the operator depresses a copy start key. In response a halogen lamp 2 (exposure lamp) is turned on, and a corona charger 3 is activated to generate a surface potential on a photosensitive drum 4. Subsequently the original support table 1 is set in motion to initiate image formation onto the photosensitive drum 4. The image of the original is focused onto the photosensitive member 4 through a short-focus fiber lens 5. An invisible latent image formed on the photosensitive member 4 is then exposed to the light from an erasure lamp 6 in unnecessary areas for charge elimination in such areas. This exposure is conducted for the purposes of uniforming fatiguing the photosensitive member 4 and of image editing, for example removal of a part of the image. Consequently the erasure lamp 6 is composed, for example, of an LED array, an EL segment array or a liquid crystal shutter array of which the light-emitting portion can be varied in the longitudinal direction. The latent image remaining after said erasure step is rendered visible by toner deposition in a developing device 7. The image is formed by the deposition of toner in an area where a static potential is present.

On the other hand, a sheet 10 supplied at a predetermined timing from a paper cassette 8 is stopped at registration rollers 9, which then feeds said sheet 10 in such a manner that the leading end of the visible image formed on the drum 4 coincides with the leading end of said sheet 10. Then said image on the drum 4 is transferred onto the sheet 10, and said transfer is facilitated by a transfer corona charger 11 functioning from the rear side of the sheet 10. Said transfer corona charger 11 is driven with a voltage slightly higher than that of the corona charger 3 which can be driven for example with a voltage of ca. 5.8 kV. Subsequently, a sheet charge elimination lamp 12 is turned on to remove the static charge on the sheet 10, thus faciliating the separation thereof from the drum 4. The sheet 10, now bearing the transferred image thereon, is transported by a conveyor belt 13, and the adhesion therebetween is ensured by a negative pressure applied by a vacuum motor 14 from the rear side of said conveyor belt 13. Subsequently the sheet 10 is subjected to heat and pressure in a fixing device 15, whereby the image is fused to the sheet 10, which is then transported to a sheet stacker 16.

The photosensitive drum 4 after the image transfer is subjected to cleaning and recovery of remaining toner in a cleaning device 17, and is exposed to the light from a charge elimination lamp 18 for eliminting the retentive potential on the photosensitive drum 4. It is then subjected again to the function of the corona charger 3 for generating a surface potential. The above-explained copying cycle is repeated for the preset number of copies.

In this copying machine, a small short-focus lens or light guide 19 is provided, alongside the short-focus lens 5, for causing an image sensor (photodiode array) 20 to detect the original document, for the purpose of image editing and automatic original density recognition. The image editing is conducted by eliminating an unnecessary portion of the image read by the image sensor 20, by means of the aforementioned erasure lamp 6. Also for reducing the cost, this copying machine employs an AC motor 21 for driving the drum 4, conveyor belt 13, sheet feed roller 22, registration rollers 9, sheet discharge rollers 23 and original support table 1, through unrepresented clutches and solenoids.

The microcontroller 30 controls the feeding, transport and fixing of the sheet 10, rotation of the motor 21, turning on and off of lamp regulator, high-voltage power source, clutches and solenoids, and also covers the key scan control for an operation/display unit and the control of a liquid crystal display unit though these units are not illustrated. The microcontroller 30 receives signals from a sensor PD for original size detection and automatic exposure control through the detection of original density pattern, a sensor SE for detecting the surface potential of the photosensitive member 4, and a temperature sensor NTC, and an input signal of a high noise level.

The microcontroller 30 receives drum clock pulses, generated by an encoder in response to the rotation of the motor 21, in order to effect timing control of the copying machine based on said pulses. The microcontroller 30 also receives zero-cross detection pulses of the AC input voltage and utilizes said pulses as timer counting pulses and also for zero-cross triggering in temperature control and exposure lamp control. The digital input/output port, analog input port, and PWM output port of the microcontroller 30 are connected to various sensors, solenoids, clutches, drivers, etc., for on/off control thereof. In this manner the microcontroller 30 completes a cycle of copying process through the steps of sheet feeding, charging, exposure, image development, image transfer, sheet transportation, image fixing, sheet dischraging and drum cleaning. In addition the microcontroller 30 detects and deals with abnormal situations. In response to the detection of a serious failure such as abnormally high fixing temperature, abnormal lighting of the exposure lamp or a sheet jamming, the copying process is immediately interrupted. On the other hand, in response to the detection of a less serious trouble, such as lack of sheet or toner, unclosed door or lid, an alarm is given to the operator. Usually such abnormality can be detected prior to the start of a copying operation.

In the following there will be given an explanation on the copying control with the microcontroller 30.

Figure 11:
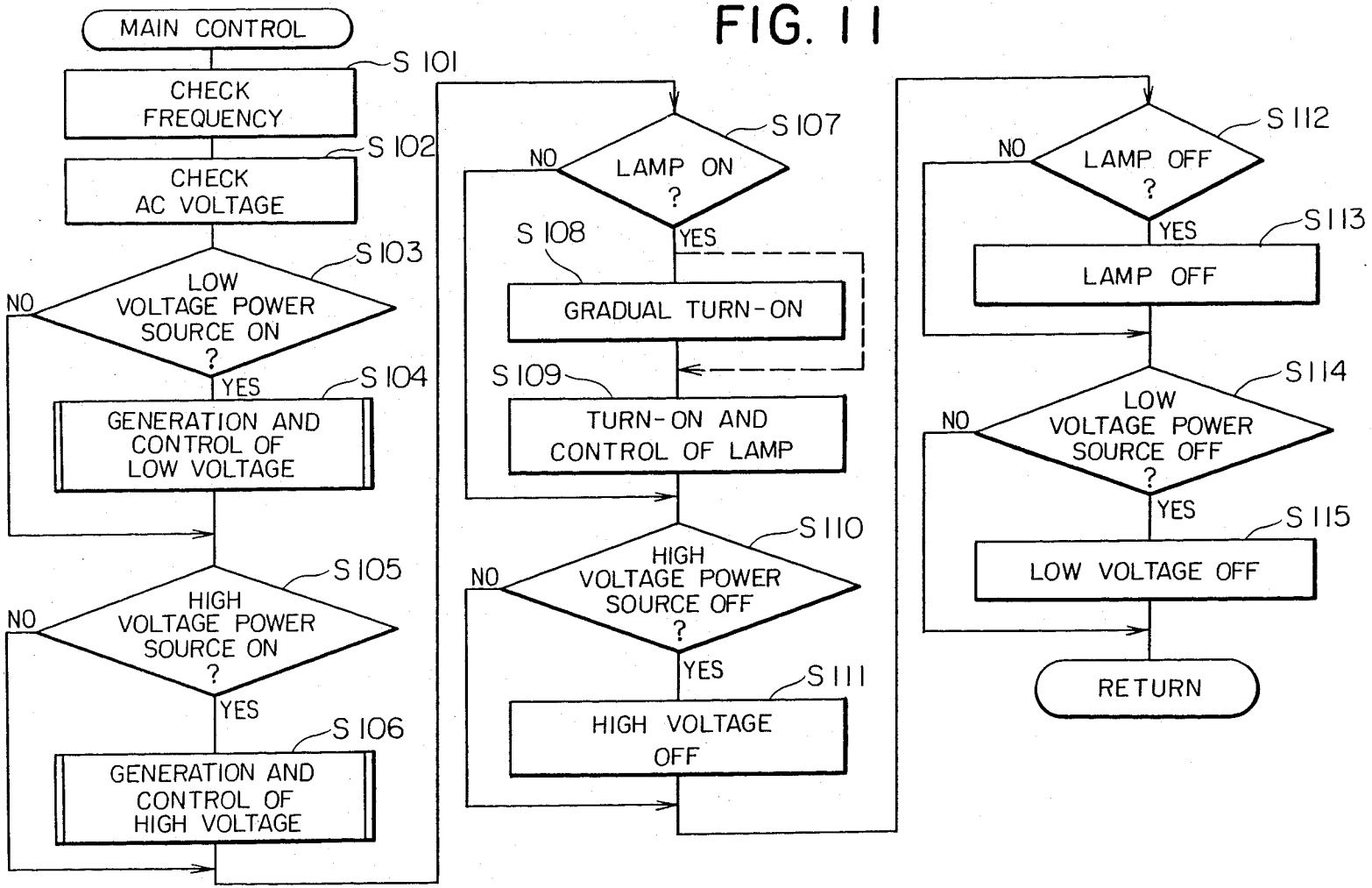
FIG. 11 is a flow chart of a main processor 37 in case of controlling a copying machine.

FIG. 11 is a main flow chart to be executed by the main processor 37. With the start of power supply to the copying machine, a voltage Vcc is supplied to the controller 30. A step S101 discriminates the frequency of the AC input power, by counting the number of zero-cross pulses received by the controller 30 within a predetermined period, for example 100 μsec, in which 10 or 12 pulses will be received for a frequency of 50 or 60 Hz, respectively. A step S102 checks the AC input voltage, thus inspecting an eventual fluctuation therein. The AC input voltage is supplied to the A/D converter of the controller 30 after voltage reduction by a transformer or after voltage division with resistors, and the macrocode processor 36 discriminates the fluctuation of the effective value of the input voltage by calculation with an approximated equation. A step S103 inspects the on-signal for a low-voltage power supply and the timing thereof, and, if they are satisfactory, a step S104 activates the low-voltage power source through the PWM output signal of the controller 30, as will be explained in more detail later. A step S105 inspects the on-signal for a high-voltage power source and the timing thereof, and, if they are satisfactory, a step S106 activates the high-voltage power source, also as will be explained later. A step S107 inspects the on-signal for a halogen lamp and the timing thereof, and, if they are satisfactory, a step S106 effects gradual turning on the lamp, in order to avoid filament breakage by a rush current. Once said lamp is turned on, the soft start step S108 is bypassed. A step S109 turns on and control the halogen lamp by detecting the effective lamp voltage and compensating said voltage to obtain a constant intensity, as will be explained later. A step S110 inspects the off-signal for the high-voltage power source and the timing thereof, and, if they are satisfactory, a step S111 turns off the high-voltage power source. A step S112 inspects the off-signal for lamp and the timing thereof, and, if they are satisfactory, a step S113 turns off the lamp. A step S114 inspects the off-signal for the low-voltage power source and the timing thereof, and, if they are satisfactory, a step S115 turns off the low-voltage power source at the completion of a copying operation.

Figure 12:
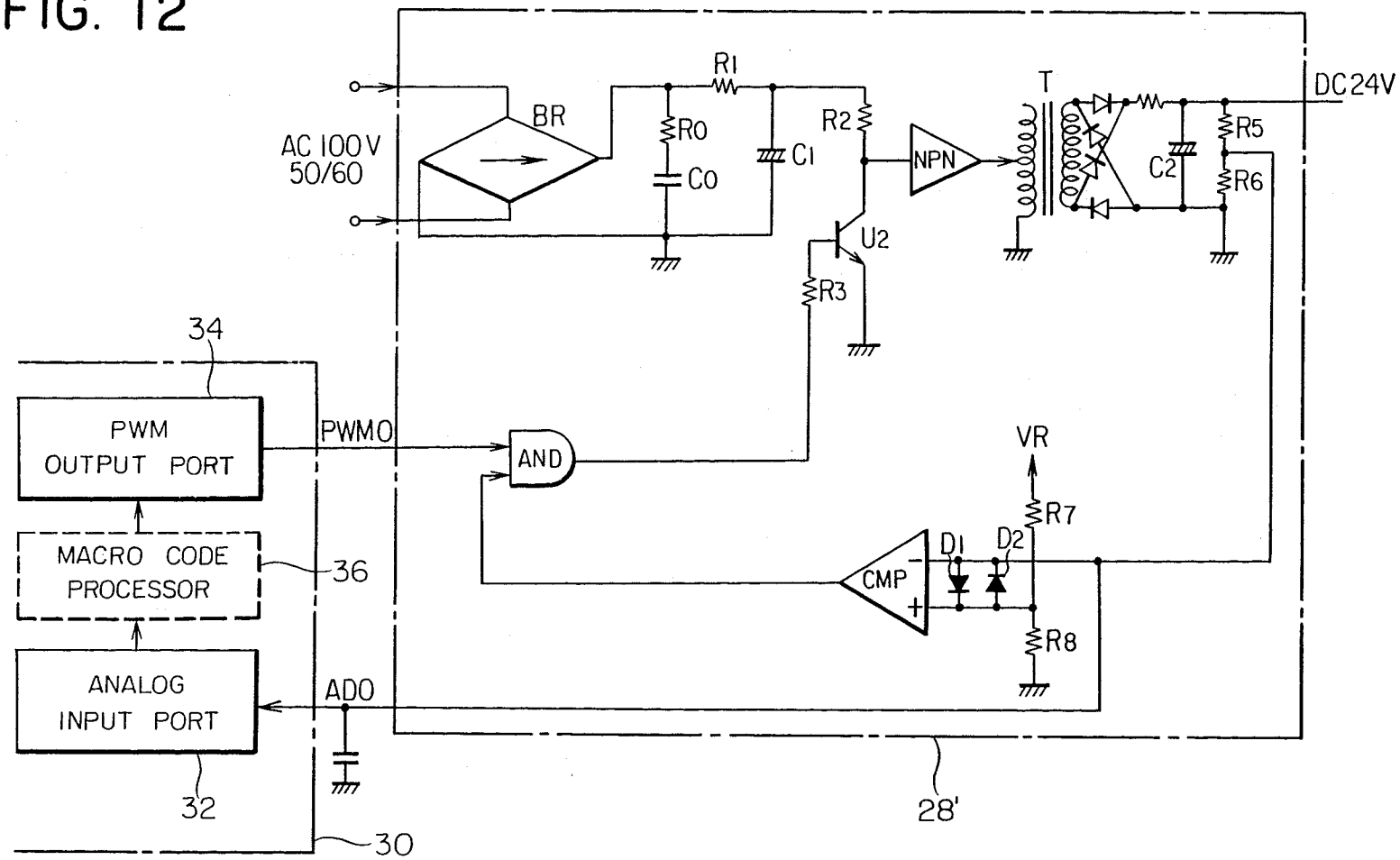
FIG. 12 is a block diagram of a low-voltage generation control circuit.

FIG. 12 is a block diagram of a low-voltage power source of a chopper type, for use in copy control, in which a low voltage output is obtained by directly rectifying an input voltage of AC 100V, and switching the voltage accumulated in a capacitor C1 with a transistor U1 and a driver NPN. The switching control is effected by the channel 0 of the PWM output port, with a frequency of 30–50 kHz. A monitor output voltage, obtained by dividing the output voltage of DC 24V with resistors R5, R6, is supplied to a comparator CMP, functioning as a protecting circuit for an excessive voltage and releasing a zero output in response to such excessive voltage, thus closing an AND gate. Said monitor output is also supplied to the macrocode processor 36 through the analog input port 32 of the controller 30. The macrocode processor 36 determines the difference between the input data and a predetermined reference value, and calculates the PWM signal so as to obtain a constant output of DC 24V. The result of said calculation is set in a corresponding register in the PWM output port 34. In sequence control with predetermined timing such as that in a copying machine, the controller 30 can predict the variation in the loads and can therefore regulates the PWM signal in advance.

Figure 13:
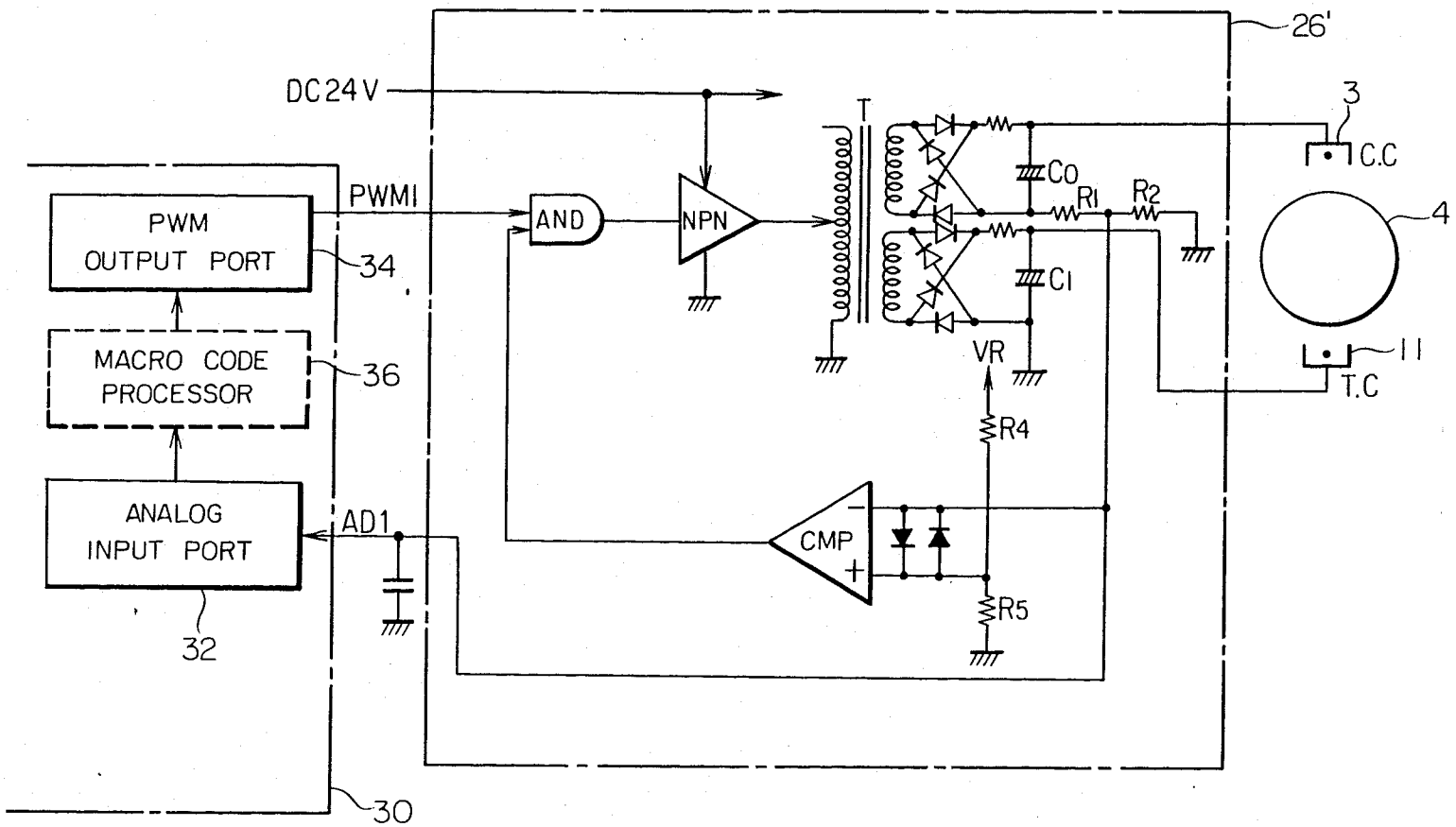
FIG. 13 is a block diagram of a high-voltage generation control circuit.

FIG. 13 is a block diagram of a high-voltage power source for use in copy control, with a similar working principle. A high voltage is generated in the high-voltage power source 26' by switching a low voltage input of DC 24V, whereas the low-voltage power source 28' generates the low voltage by switching a smoothed voltage obtained from the input voltage of AC 100V. The control is conducted in a similar manner by an output signal PWM1 of the channel 1 of the PWM output port 34, and a high-speed switching is conducted in a high-frequency transformer T to obtain high voltages required for the corona charger 3 and the transfer corona charger 11, which are respectively operated at ca. 5.8kV and ca. 6.2kV. A monitor output voltage, obtained by dividing the output voltage of the corona charger 3 with resistors R1, R2, is supplied to a monitor comparator CMP which releases a zero signal in response to an abnormally high voltage, thereby closing an AND gate. Said monitor voltage is also supplied to the channel 1 of the analog input port 32, and, in response, the macrocode processor 36 determines the duty ratio of the signal PWM1 to obtain a stable high voltage output. In the circuits shown in FIGS. 12 and 13, an abnormality in the voltage can be checked in digital manner through the analog input port 32, but the presence of the protecting comparator provides additional safety even in the case of an eventual failure of the controller 30.

The control of the halogen lamp 2 was already explained in relation to FIGS. 6 and 7 and will not be, therefore, repeated.

As explained in the foregoing, a centralized control of a copying machine with the control device 30 of the foregoing embodiment allows one to simplify the control cirucit structure of the copying machine involving plural analog variable. Also such centralized control with a single control circuit improves the reliability of control.

The control device 30 of the foregoing embodiment can be applied, not only to a copying machine, but also to any image forming apparatus or image processing apparatus involving plural analog processing devices.

Also the present invention is not limited to the foregoing embodiment but is subject to various modifications within the scope and spirit of the appended claims.

We claim:

1. A control device for use in an image processing apparatus, comprising:

plural analog function means for image processing;

plural detection means for detecting analog variables of said plural analog function means;

analog-digital conversion means for converting analog signals from said plural detection means into digital signals;

first control means for controlling an image processing sequence, and for deciding, on the basis of the digital signals from said analog-digital conversion means, whether or not the analog variables of said plural analog function means should be changed, and for generating instructions for changing the analog variables to specific one or more of said plural analog function means; and second control means for controlling the analog variables of said one or more analog function means specified by the instructions in response to the instructions.

2. A control device according to claim 1, wherein said second control means includes plural generating means for generating pulse signals having respective pulse widths based on analog signals from said plural analog function means, and outputting the pulse signals to said plural analog function means, and wherein said second control means changes pulse width of the pulse signal to said one or more analog function function means specified by the instructions.

3. A control device for use in an image processing apparatus, comprising:

analog function means for image processing;

detection means for detecting an analog variable of said analog function means;

means for discriminating whether a level of an analog signal from said detection means is within a predetermined range or not, and for producing an interrupt signal if the level is not within the range;

memory means storing therein a control program for image processing and an analog control program; and control means for performing image processing control and analog control in accordance with the program stored in said memory means, wherein said control means suspends the program for image processing control and executes one of the analog control programs if said control means receives the interrupt signal.

4. A control device according to claim 3, wherein said control means controls said analog function means so as to regulate the level of the analog signal to be within the predetermined range.

5. A control device according to claim 3, wherein said interrupt signal producing means includes analog-digital conversion means for converting the analog signal from said detection means into a digital signal, and said interrupt signal producing means discriminates whether the converted digital signal is within a predetermined range or not.

6. A control device according to claim 3, further comprising pulse-width adjusting means for pulse-width controlling said analog function means, and wherein said control means controls said pulse-width adjusting means.

7. A control device according to claim 6, wherein said control means sets pulse-width data in said pulse-width adjusting means and said pulse-width adjusting means repeatedly supplies a pulse signal having a pulse width based on the pulse-width data set by said control means, to said analog function means in a predetermined period.

8. A control device according to claim 3, wherein said interrupt signal producing means and said control means are provided on one semiconductor chip.

9. A control device for use in an image processing apparatus, comprising:

plural analog function means for image processing;

plural detection means for detecting analog variables of said plural analog function means;

analog-digital conversion means for converting analog signals from said plural detection means into digital signals;

memory means storing therein a control program;

control means operable according to the program stored in said memory means, for controlling said plural analog function means on the basis of the digital signals from said analog-digital conversion means; and plural generating means for generating pulse signals having respective pulse widths based on analog signals from said plural analog function means, and for outputting the pulse signals to said plural analog function means;

wherein said plural generating means each have means for retaining pulse-width data from said control means and generate the pulse signals repeatedly in a predetermined period in accordance with the retained pulse-width data.

10. A control device according to claim 9, wherein said retaining means each include a counter for retaining the pulse-width data and wherein said plural generating means repeatedly generate pulse signals in a predetermined period in accordance with the pulse-width data of the respective counter.

11. A control device according to claim 9, wherein said control means includes first control means for administering control sequences of said plural analog function means, and second control means for controlling said analog function means to effect image processing, by executing a particular instruction specified by said first control means, in reference to plural analog-digital converted outputs from said analog-digital conversion means.

12. A control device according to claim 11, wherein said analog-digital conversion means supplies said first control means with a demand for interruption procedure after the completion of conversion, and in response to said demand, said first control means supplies said second control means with said particular instructions.

13. A control device according to claim 12, wherein said analog-digital conversion means comprises discriminating means for discriminating whether the converted data are appropriate and supplies said first control means with a demand for interruption procedure in a case in which said converted data are not appropriate, and said first control means causes said second control means to control analog function means corresponding to said inappropriate data.

14. A control device according to claim 12, wherein said analog-digital conversion means comprises scan means for scanning the plural detection signals according to scan data released by said first control means.

15. A control device according to claim 11, wherein said memory means stores a control program for controlling said first control means and a control program for controlling said second control means.

16. A control device for use in an image forming apparatus, comprising:

analog function means for image formation;

detection means for detecting an analog variable of said analog function means;

analog-digital conversion means for converting an analog signal from said detection means into a digital signal;

memory means storing therein a control program;

control means operable according to the program stored in said memory means, for controlling said analog function means on the basis of the digital signal from said analog-digital conversion means; and generating means for generating a pulse signal having a pulse width based on the analog signal from said analog function means, and for outputting the pulse signal to said analog function means, wherein said control means includes means for calculating pulse-width data to adjust the analog variable of said analog function means to a predetermined analog variable on the basis of the digital signal converted by said analog-digital conversion means, and for outputting the pulse-width data to said generating means, and wherein said generating means includes means for retaining the pulse-width data from said control means and generates the pulse signal having a pulse width corresponding to the pulse-width data in a predetermined period in accordance with the retained pulse-width data.

17. A control device according to claim 16, wherein said retaining means comprises a counter.

18. A control device according to claim 16, wherein said control means includes first control means for administering control sequences of said analog function means, and second control means for controlling said analog function means to effect image processing, by executing a particular instruction specified by said first control means, in reference to plural analog-digital converted outputs from said analog-digital conversion means.

19. A control device according to claim 18, wherein said analog-digital conversion means supplies said first control means with a demand for interruption procedure after the completion of conversion, and, in response to said demand, said first control means supplies said second control means with said particular instructions.

20. A control device according to claim 19, wherein said analog-digital conversion means comprises discrimination means for discriminating whether the converted data are appropriate, and supplies said first control means with a demand for interruption procedure in a case in which the converted data are not appropriate, and, in response, said first control means causes said second control means to control analog function means corresponding to the inappropriate data.

21. A control device according to claim 19, wherein said analog-digital conversion means comprises scan means for scanning the plural detection signals according to scan data released by said first control means.

* * * * *